United States Patent [19]

Cavallero

[11] Patent Number: 5,067,394

[45] Date of Patent: Nov. 26, 1991

[54] AIRBORNE PARTICLE EXHAUST SYSTEM

[76] Inventor: Thomas Cavallero, 5714 Maywood Dr., Foresthill, Calif. 95631

[21] Appl. No.: 562,036

[22] Filed: Aug. 2, 1990

[51] Int. Cl.[5] ..... F24F 11/00

[52] U.S. Cl. ..... 98/42.03; 98/42.06

[58] Field of Search ..... 98/42.04, 42.03, 42.06

[56] References Cited

U.S. PATENT DOCUMENTS

| | | | |
|---|---|---|---|
| 3,826,180 | 7/1974 | Hayashi | 98/42.03 |
| 3,884,133 | 5/1975 | Miller | 98/42.03 |
| 4,068,568 | 1/1978 | Moss | 98/42.03 X |
| 4,765,231 | 8/1988 | Aniello | 98/42.03 |

FOREIGN PATENT DOCUMENTS

| | | | |
|---|---|---|---|
| 2448057 | 8/1980 | France | 98/42.03 |

*Primary Examiner*—Harold Joyce

[57] ABSTRACT

Harmful or hazardous airborne particles are drawn from rooms, hallways, or work areas by a duct work which is coupled to a vacuum system. When hazardous airborne particles are detected, the vacuum system is activated to evacuate the particles from the area. The system can also be activated manually to exhaust airborne pollutants. The system exhausts airborne particles to the outside of a building or into a filter. In an emergency, occupants of a burning or contaminated structure are provided with an initially greater period of time in which to effect an escape before the atmosphere within the structure becomes lethal. When under manual control, the occupant's of the structure are able to control the quality of air in the structure and enjoy a healthier, safer environment.

11 Claims, 2 Drawing Sheets

AIRBORNE PARTICLE EXHAUST SYSTEM

BACKGROUND OF THE INVENTION

1. Field of the Invention

The present invention relates to building exhaust and ventilation systems. More particularly, the present invention relates to a system that exhausts harmful smoke, gases, or pollutants from a building in emergency and non-emergency situations.

2. Description of the Prior Art

Most fire fatalities are the result of the victim's succumbing to the deleterious effects of smoke and gas inhalation and not to the effects of the fire itself. During a fire, the airborne particles that result from combustion fill areas in the burning structure choking available air supplies and blocking escape. Many of these victims are suffocated by smoke and gas while trying to escape from a fire because such smoke and gas have displaced the breathable air in the building.

Today's advancements in material technology have exacerbated the hazards attendant with combustion byproducts and airborne particles in both the home and the work place. New building materials and their chemical combinations and combustion byproducts can produce deadly smoke and fumes, even during minor fires. Compounding this hazard is the modern practice of building air tight, energy efficient office buildings and homes that seal in harmful fumes and airborne particles during a fire or other emergency. A device that allows additional escape time during an emergency by removing airborne particles from the air supply along an escape route or area would provide a much improved survival rate for victims of fires in homes, offices, and other structures.

In the prior art, two similar ideas address the issue of maintaining air quality in a burning structure. In U.S. Pat. No. 4,765,231, *A Smoke Exhausting air Conditioning System,* an existing air delivery system and reverse delivery fan motors are used to evacuate smoke in an affected building. During smoke evacuation, the system controls a series of motors to direct smoke through a series of ducts. The system uses fans to push air through a supply duct. This contaminates the fresh air supply system for the building making the supply system unusable until it is cleaned. Such cleaning can be prohibitively expensive, involving replacement of duct work and other associated costs, downtime for the system and resulting loss of use of the building until the system is restored. Degraded supply system performance may also result due to residual contamination that cannot be corrected by cleaning. A detector control for such prior art system is designed to operate the system only in response to smoke and does not address the issue of hazardous fumes or other noxious pollutants. The hardware requirements for such system include an expensive central air conditioning system. Such air conditioning systems are not specifically designed to operate as a low speed pollutant exhaust. They have no provision for such function and must be significantly modified in place before such prior art can be used.

Another approach shown in the prior art is shown in U.S. Pat. No. 3,884,133, *A Fire Control System For Multi-Zoned Buildings.* The '133 invention is based on the principle of removing smoke from one area of a multi-zoned building while supplying air under pressure to other areas of the building, thereby slowing the spread of the fire. This operation is accomplished by controlling a complex arrangement of several ducts and fans, moving air in and out of rooms to exhaust heat and smoke, while providing positive pressure to other rooms.

The foregoing system is difficult to build, hard to reliably control and, in the event of failure could spread a fire or smoke more quickly, thereby reducing the survival rate of the structure's occupants.

SUMMARY OF THE INVENTION

The present invention operates on a vacuum principle, not a pressure principle as in the prior art. The present invention is intended for use in emergency and non-emergency modes. In one embodiment of the invention, a central vacuum system is operated to eliminate household and work place pollutants and contaminants, as well as combustion byproducts. Another embodiment of the invention provides collection and filtration of airborne particles.

The present invention is installed in, added to, or configured as a central vacuum unit of the type used in residences and hotels for cleaning rugs, carpets, and other types of floors. Controlled air registers are placed at locations from which airborne particles may be most expeditiously removed. For smoke exhaust this location would be hallways, corridors, or stairwells; other locations would be determined by the suspected hazard. For example, the present invention could be combined with kitchen and bathroom exhausts to remove unpleasant odors from a building, or it could be combined with vapor or chemical exhaust systems in an industrial setting to remove dangerous fumes.

A sensor device, when activated, operates to open an exhaust register and activate the vacuum system. An alarm may also be sounded to alert occupants of a hazardous condition in the building. For example, in one embodiment of the invention the sensor is a smoke detector coupled to a central vacuum system which includes several exhaust registers. In such system, the airborne particles are removed via the registers and exhausted either outside of the structure or to a filtration or collection point.

In another embodiment of the invention, a manually operated system is provided to exhaust unwanted airborne particles in a less critical setting or environment, such as for household or other indoor pollution, low level health hazards, or non-life-threatening industrial fumes or gases. Manual operation of the invention does not initiate an alarm, but does operate a variable speed motor to control the amount of vacuum as is necessary to remove the undesired substance from the air.

When the present invention is installed in conjunction with a central vacuum unit, both systems can use a shared duct with the common duct extended to the exhaust register locations. In such way, installation cost of the unit is minimized and the logistics of installation in an existing structure are greatly simplified. The vacuum unit is modified to bypass smoke around the vacuum unit's filter or collection point if desired, and an external filter is substituted in its place. A variable speed motor or motor control is added which is responsive to both manual activation and emergency activation by a smoke or other hazard sensor. Thus, the same system is used as a central vacuum unit, a safety exhaust system, and a ventilation system (by reversing the motors).

DETAILED DESCRIPTION OF THE INVENTION

The present invention is an airborne particle exhaust vacuum system that is of a modular design and that can be configured in several ways, including as an original installation or as a retrofit to existing systems.

Figure 1:
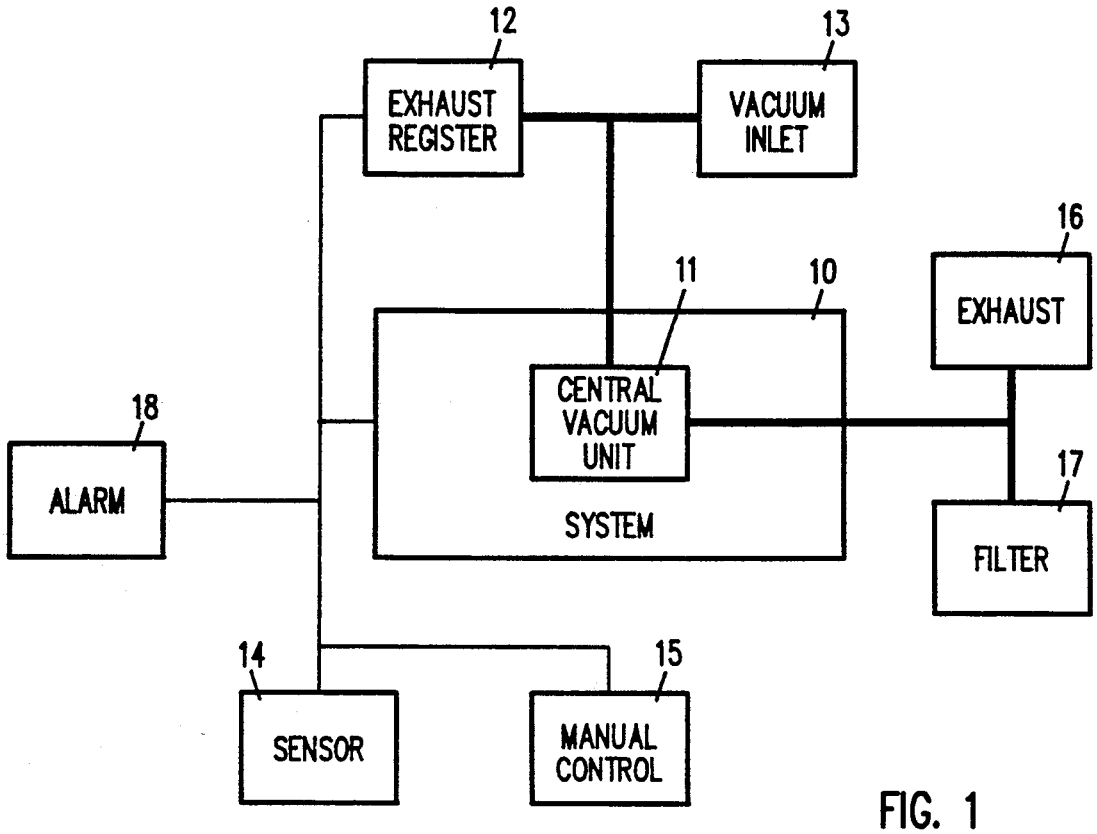
FIG. 1 is a block schematic representation of one embodiment of the present invention.

FIG. 1 shows the present invention configured as a safety device, including a central vacuum function and a ventilation function. This embodiment of the invention finds its best application in homes or small offices, although other applications may be readily available for the invention. By combining the three above functions into one unit an economy or cost saving is achieved.

The system 10 includes a central vacuum unit 11 coupled to exhaust register 12 and vacuum inlet 13. Central vacuum unit is operable in response to control signals from either sensor 14 or manual control 15. A signal from sensor 14 also operates exhaust register 12. System 10 is configured to either exhaust airborne particles outside of a structure via exhaust 16, or collect particles in a collection unit 17.

Exhaust register 12 is located in the area from which particles are to be removed and is operated by sensor 14 or manual control 15. Although one exhaust register 12 is shown in FIG. 1, it will be appreciated by those skilled in the art that a plurality of exhaust registers may be provided as are required for a particular structure or application. Sensor 14 is of the type known in the art for detecting smoke (e.g. a smoke detector) or for detecting other noxious or hazardous substances. In applying the invention, several sensors may be used at various location for detecting various types of fumes or smoke. An alarm 18 is included to warn occupants in the structure of the hazard. Various alarms can indicate different conditions and the alarm may be either visual or aural, or both.

When the vacuum unit 11 is used as a central vacuum cleaner unit, exhaust registers 12 remain closed and vacuum inlets 13 are accessed. When fumes are to be removed, either through sensor actuation or by manual operation, vacuum inlets 13 remain closed and exhaust register 12 is opened.

Vacuum unit 11 may be operable at various power levels. For example, a high power level may be used to exhaust dangerous contaminants from the structure; a medium power level may used when the invention is operated as a vacuum cleaner; and a lower power level may be used when the exhaust system is manually operated to remove undesirable, but otherwise harmless, fumes or odors.

During normal operation as a vacuum cleaner, dirt removed by the system is collected in collection unit or filter 17. During emergency or manual exhaust operation, fumes or smoke are vented to the outside of the structure via exhaust 16. In some embodiments of the invention, smoke or fumes may be collected in a filter unit to prevent air pollution (e.g. when hazardous chemical fumes are exhausted), or the collection unit may serve to collect both dirt and airborne particles.

Figure 2:
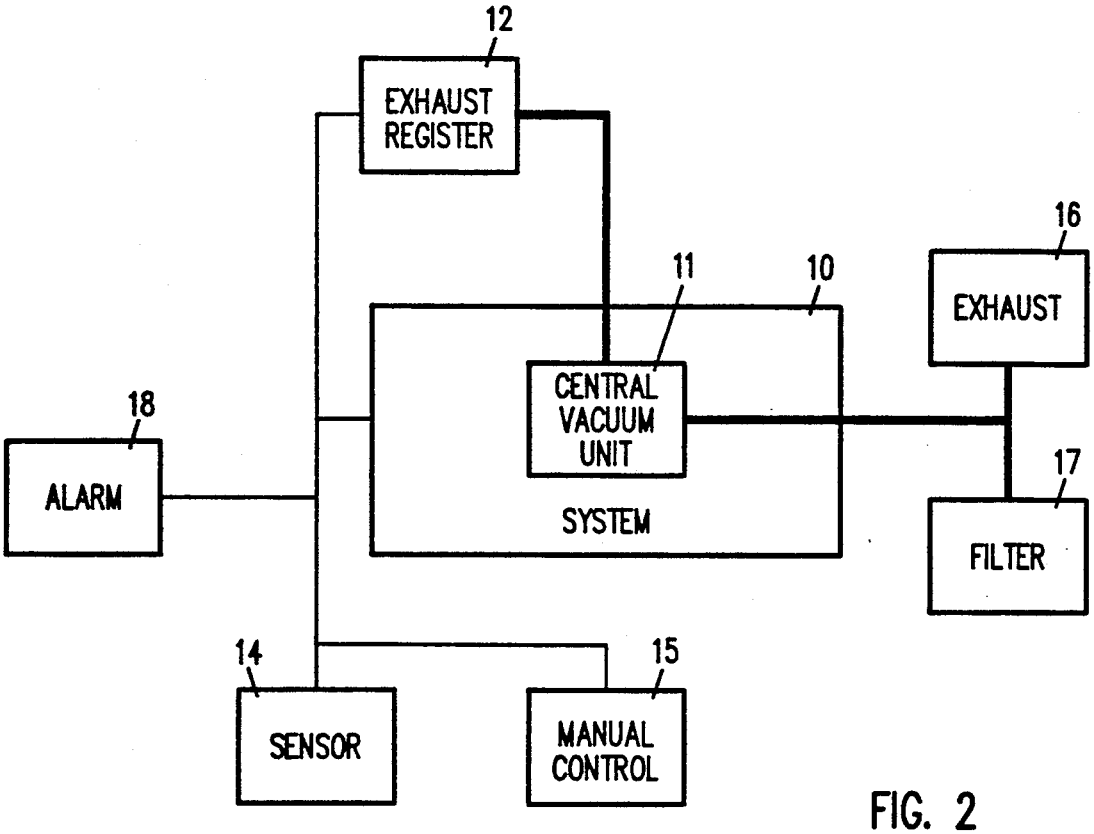
FIG. 2 is a block schematic representation of a second embodiment of the present invention.

FIG. 2 shows an embodiment of the invention in which a stand-alone exhaust system is provided, without a central vacuum cleaning function. For purposes of the disclosure, the numerals in each Figure designate like elements of the invention. Accordingly, in FIG. 2 vacuum unit 11 is coupled to exhaust register 12 and operates under control of sensor 14 or manual control 15 to exhaust smoke, fumes, and airborne particles via exhaust 16 or collection unit 17.

Figure 3:
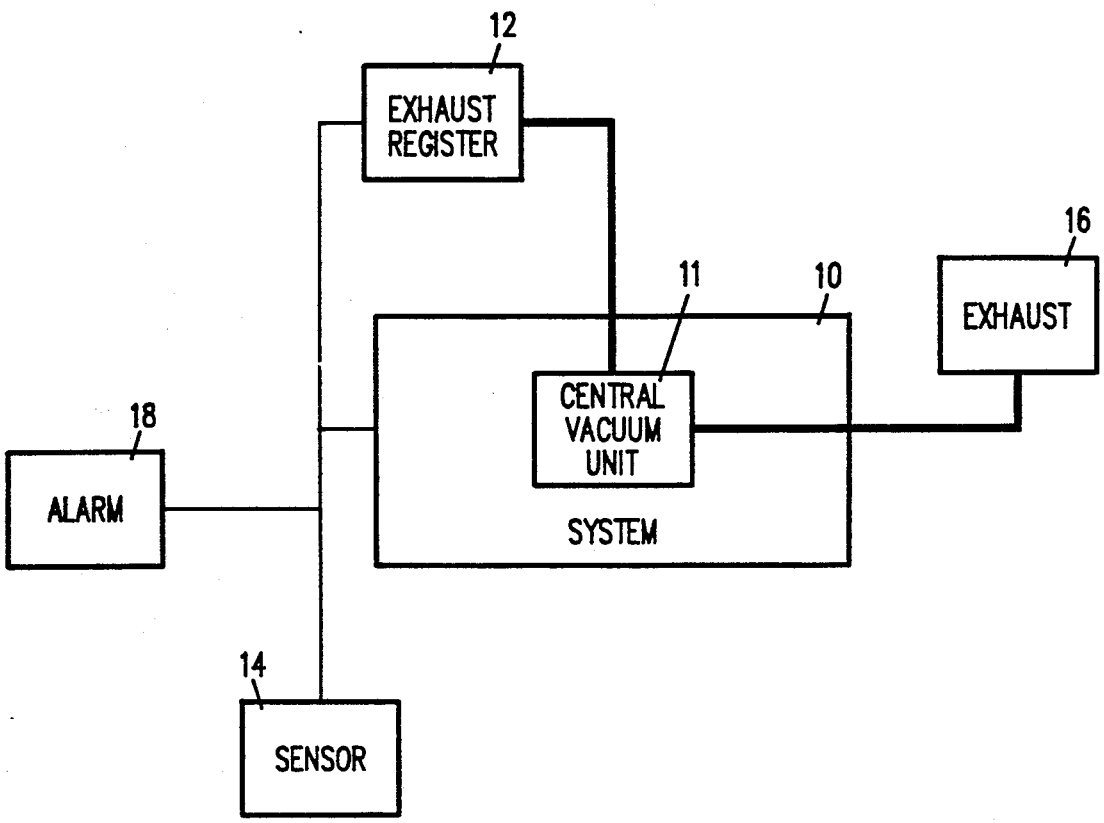
FIG. 3 is a block schematic representation of a third embodiment of the present invention.

FIG. 3 shows an embodiment of the invention configured solely to operate as a safety device for exhausting smoke, fumes, or other airborne particles from a structure. Thus, a vacuum unit 11 operates an exhaust register 12 in response to a sensor 14 to remove airborne particles via exhaust 16.

Although several embodiments of the invention have been described above, such embodiments are intended to illustrate the invention. The scope of the invention should only be limited as determined from the appended claims.

I claim:

1. A central vacuum cleaning device, incorporating a safety device, the safety device comprising:

means for detecting airborne particulants;

means responsive to said detecting means remotely locatable therefrom and for supplying a vacuum for operating said vacuum cleaning device as a safety device in response to said detecting means and for otherwise operating said vacuum cleaning device as a central vacuum cleaner;

means coupled to said vacuum means remotely locatable therefrom and for porting detected airborne particulants from a structure in response to said vacuum means when said vacuum cleaning device is operated in response to said detecting means as a safety device and for porting particles collected when said vacuum cleaning device is operated as a central vacuum cleaner;

means coupled to said vacuum means remotely locatable therefrom and for discharging said airborne particulants collected by said porting means at a collection or dispersal location when said vacuum cleaning device is operated in response to said detecting means as a safety device.

2. The safety device of claim 1, further comprising alarm means for indicating system actuation.

3. The safety device of claim 1, wherein said vacuum means is operable in response to actuation of a manual control means.

4. The safety device of claim 1, wherein said vacuum means is operable at a plurality of selected power levels.

5. The safety device of claim 1, further comprising a vacuum port operable under manual control as a cleaning means for removing undesirable particles from a structure.

6. In a central vacuum cleaner system situated in a structure and operable at least one vacuum port for collecting undesired particles and for routing said particles to a collection point, an exhaust system for withdrawing contaminated air from said structure, comprising:

means for operating said central vacuum cleaner system as a safety device in response to a detecting means and for otherwise operating said vacuum cleaning system as a central vacuum cleaner, said means being remotely locatable from said central vacuum system for actuating said central vacuum system;

means, coupled to said central vacuum system and remotely locatable therefrom, within said structure for porting said contaminated air from said structure when said central vacuum cleaner system is operated in response to said detecting means as a safety device and for porting particles collected when said central vacuum cleaning system is operated as a central vacuum cleaner; and means, coupled to said central vacuum cleaner system and remotely locatable therefrom, for discharging said contaminated air from said structure when said central vacuum cleaning system is operated as a safety device.

7. The system of claim 6, wherein said means for actuating is operable in response to user selection.

8. The system of claim 6, wherein said means for actuating is operable in response to an environmental hazard.

9. The system of claim 8, wherein said environmental hazard is a combustion by product.

10. The system of claim 8, wherein operation of said actuating means operates an alarm means for indicating said actuation.

11. The system of claim 6, wherein said discharging means is operable to collect airborne particles contained in said contaminated air.

* * * * *